US005890521A

United States Patent [19]

Dunn

[11] Patent Number: 5,890,521

[45] Date of Patent: Apr. 6, 1999

[54] MULTI-USE CRAFTSMAN TABLE

[76] Inventor: Scott Allan Dunn, 7020 Redwood Blvd. Apt. 15, Novato, Calif. 94945

[21] Appl. No.: 855,220

[22] Filed: May 12, 1997

[51] Int. Cl.[6] ..... B27C 9/00

[52] U.S. Cl. ..... 144/1.1; 26/26 A; 26/27 R; 144/35.1; 144/286.1; 144/286.5; 144/365; 408/20; 451/340

[58] Field of Search ..... 144/2.1, 286.1, 144/286.5, 365; 269/241 R; 29/26 A, 27 R, 27 A, 560; 408/20, 21, 24; 83/571; 142/49; 451/340

[56] References Cited

U.S. PATENT DOCUMENTS

| | | | |
|---|---|---|---|
| 2,619,135 | 11/1952 | Callaway | 144/1.1 |
| 3,071,889 | 1/1963 | Silver | 144/35.1 |
| 4,649,608 | 3/1987 | Fresard | 29/26 A |
| 4,915,148 | 4/1990 | Fox | 144/1.1 X |
| 5,009,255 | 4/1991 | Fournel | 144/1.1 |
| 5,515,894 | 5/1996 | Dunn | 144/1.1 |
| 5,562,135 | 10/1996 | Beth et al. | 144/1.1 |
| 5,653,273 | 8/1997 | Bach | 144/1.1 |

*Primary Examiner*—W. Donald Bray
*Attorney, Agent, or Firm*—Michael I. Kroll

[57] ABSTRACT

A multi-use craftsman table (10) for connection of at least one of a plurality of tools (14) for performing a variety of operations on wood work pieces is disclosed by the present invention. The multi-use craftsman table (10) includes a tool table top (16) and a bracket (78) having at least one clamp (80, 82) for releasably securing at least one of the plurality of tools (14) thereto connected to the tool table top (16). The tool table top (16) includes a face side and a bottom side. The face side includes a recess (25) extending therethrough, and first and second grooves (28) extending on either side of the recess (25) and along the length of the face side. The bottom side includes means for connecting (106) the bracket (78) thereto wherein the at least one of said plurality of tools (14) is aligned with the recess (25). At least one leg (18) is releasably connected to the bottom side of the tool table top (16). The at least one leg (18) includes a top end and bottom end (20), the top end is releasably connected to the bottom side of the tool table top and the bottom end includes a machined slot (22) for receiving a clamp (24). The clamp (24) acts to secure the multi-use craftsman table (10) to a table top (34) of a work table (32).

20 Claims, 6 Drawing Sheets

MULTI-USE CRAFTSMAN TABLE

BACKGROUND OF THE INVENTION

1. Field of the Invention

The instant invention relates generally to machine shop tools and, more specifically, to a multi-use craftsman table.

2. Description of the Prior Art

Numerous machine shop tools have been provided in the prior art. For example, U.S. Pat. Nos. 2,619,135 to Callaway; 3,071,889 to Silver; 4,649,608 to Fresard et al.; 5915,148 to Fox and 5,009,255 to Fournel all are illustrative of such prior art. While these units may be suitable for the particular purpose to which they address, they would not be as suitable for the purposes of the present invention as heretofore described.

U.S. Pat. No. 2,619,135

Inventor: ALFRED S. CALLAWAY

A multiple machine tool in which there is provided a base, a standard, a column and a drill press head. Instead of securing all of the elements to the column, only a portion thereof is mounted on the column, namely, the drill press head, tail-stock and associated elements. There is further provided on the base a tool-stand fixed thereto. A table operating from the tool stand is adapted to be raised and lowered and tilted at various angles. On the tool-stand is provided means for alternately clamping various machine tools in such positions that the shafts thereof may couple with the quill of the drill press head. The table may be shifted into various positions, depending on the particular tool mounted on the stand, so that it cooperates therewith or is displaced so as not to interfere with the operation thereof. When coupled with such removable machine tools, the column is in horizontal position and is anchored to the tool stand.

U.S. Pat. No. 3,071,889

Inventor: JULIAN SILVER

A convertible wood type machine shop toy is motor driven and can be operated by a child, to teach him the basic wood working machine operations without danger of being injured. It is adapted to work with expanded polystyrene, plastic foam or the like material. All of the regular woodworking type machine shop operations of circular saw cutting, jig saw cutting, face plate turning, center turning drilling, disc sanding and spindle sanding can be performed with the one toy by a simple rearrangement of the parts of the toy to adapt it for any one of the operations. The cutting discs, saws and cutting tools are non-metal and made of soft enough plastic or wood, to prevent the child from being cut or injured. The parts can be arranged and assembled upon one another in a Peg Board manner.

U.S. Pat. No. 4,649,608

Inventor: MARCEL FRESARD et al.

In an upper arm is mounted a spindle head and in a lower frame two power takeoffs. An electric motor drives either a spindle or the power takeoffs in rotation. Thus, the operations of milling, scroll cutting, sanding, grinding, polishing, sawing, etc., can be performed from the upper arm or the power takeoffs of the lower frame of the machine.

U.S. Pat. No. 4,915,148

Inventor: ANTHONY FOX

A specially designed jointer is provided as an accessory attachment to a multipurpose power tool assembly described in U.S. Pat. No. 4,349,945. The jointer may be mounted on the same bench surface as the multipurpose power tool itself. A tubular coupler is used to join the power take-off shaft of the multipurpose power tool to the jointer's drive shaft. The same drive motor used for the multipurpose power tool can also provide power to the jointer.

U.S. Pat. No. 5,009,255

Inventor: PAUL FOURNEL

A multipurpose machine tool, which can include and provides for drilling, sawing, shaping, planning functions, all mounted in a sturdy frame of parallelepiped shape.

SUMMARY OF THE PRESENT INVENTION

A primary object of the present invention is to provide a multi-use craftsman table that will overcome the shortcomings of prior art devices.

Another object of the present invention is to provide a multi-use craftsman table, which can readily be converted with specific tool accessories to perform a variety of operations on wood work pieces, according to known machining operations.

An additional object of the present invention is to provide a multi-use craftsman table that includes a tool table, which can be adjustably mounted to a work table, so that the variety of operations such as drilling, shaping, routing, sanding, sawing, turning and milling can be performed by assembling the specific tool accessories for any of the operations on the tool table.

A further object of the present invention is to provide a multi-use craftsman table having a recess in the table top and a bracket for holding a motor tool below the recess, the motor tool being adapted to connect with and provide power to a plurality of different tools which act on a workpiece positioned on the other side of the recess.

A yet further object of the present invention is to provide a multi-use craftsman table including a plurality of plates or inserts which are each positionable atop the table, each plate acting to guide movement of a respective tool through the table top to contact a work piece on the top side of the table.

A still further object of the present invention is to provide a multi-use craftsman table having detachable legs, each leg including a machined slot at a bottom end thereof for receiving and securing a C-clamp thereto.

An even further object of the preent invention is to provide a multi-use craftsman table including grooves along a length thereof and a guide member for movement along the grooves to guide a work piece along the length of the table.

Another object of the present invention is to provide a multi-use craftsman table that is simple and easy to use.

A still further object of the present invention is to provide a multi-use craftsman table that is economical in cost to manufacture.

Additional objects of the present invention will appear as the description proceeds.

A multi-use craftsman table for connection of at least one of a plurality of tools for performing a variety of operations on wood work pieces is disclosed by the present invention. The multi-use craftsman table includes a tool table top and a bracket having at least one clamp for releasably securing at least one of the plurality of tools thereto connected to the tool table top. The tool table top includes a face side and a bottom side. The face side includes a recess extending therethrough, and first and second grooves extending on either side of the recess and along the length of the face side. The bottom side includes means for connecting the bracket thereto wherein the at least one of said plurality of tools is aligned with the recess. At least one leg is releasably connected to the bottom side of the tool table top. The at least one leg includes a top end and bottom end, the top end is releasably connected to the bottom side of the bottom side of the tool table top and the bottom end includes a machined slot for receiving a clamp. The clamp acts to secure the multi-use craftsman table to a table top of a work table.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views, and wherein.

LIST OF REFERENCE NUMERALS

Figure 1:
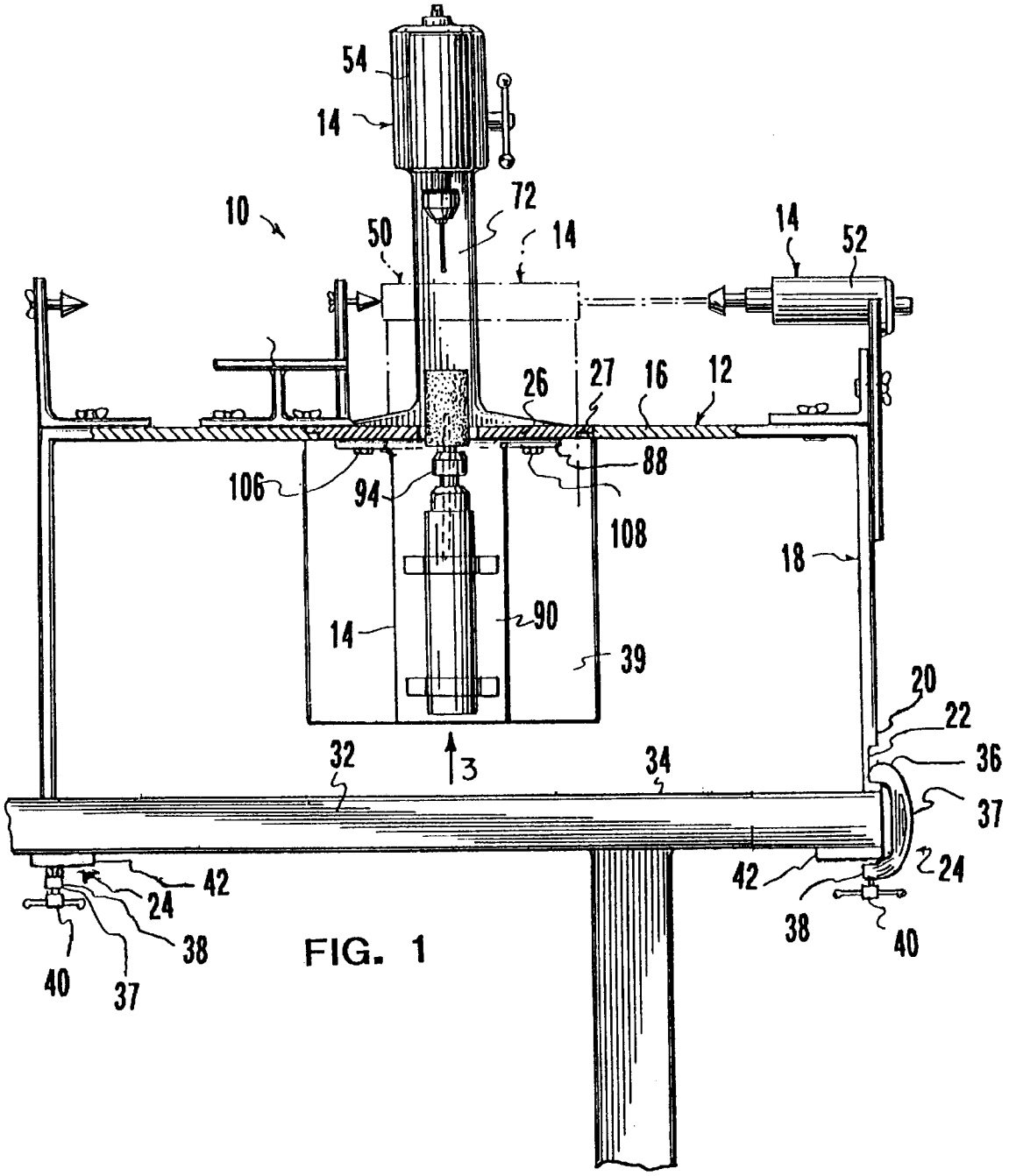
FIG. 1 is a perspective side view of the multi-use craftsman table of the present invention with parts broken away and in section, mounted to a work table and including a plurality of tools attached thereto.

Turning now descriptively to the drawings, in which similar reference characters denote similar elements throughout the several views, the Figures illustrate the multi-use craftsman table of the present invention. With regard to the reference numerals used, the following numbering is used throughout the various drawing figures.

| | |
|---|---|
| 10 | multi-use craftsman table |
| 12 | tool table |
| 14 | tool accessory |
| 16 | top of tool table |
| 18 | legs of tool table |
| 20 | lower portion of leg |
| 22 | machined slots in leg |
| 24 | C-clamp |
| 25 | recess |
| 26 | guide plate |
| 27 | ledge |
| 28 | pair of grooves in table top |
| 29 | connector |
| 30 | cross-cut guide member |
| 31 | combination rip fence and turning tool rest |
| 32 | work table |
| 34 | table top of work table |
| 36 | securing jaw of C-clamp |
| 37 | mid-section of C-clamp |
| 38 | free jaw of C-clamp |
| 40 | fastening screw |
| 42 | rubber pad |
| 44 | table saw tool accessory |
| 50 | belt sander tool accessory |
| 52 | wood lathe tool accessory |
| 54 | drill press tool accessory |
| 56 | radial arm saw tool accessory |
| 53 | tool rest support on the table top |
| 60 | latch mechanism of the table saw |
| 62 | first roller of the belt sander |
| 64 | longitudinal arm of the radial arm saw |
| 66 | spring pivot on the longitudinal arm of the radial arm saw |
| 68 | adjustable collar of the longitudinal arm |
| 70 | locking screw in the adjustable collar |
| 72 | upstanding column on the tool table top |
| 74 | clip |
| 76 | sand paper |
| 78 | bracket |
| 80 | first clamp |
| 82 | second clamp |
| 84 | motor end |
| 86 | motor tool |
| 88 | first top side of bracket |
| 90 | second vertically extending side of bracket |
| 92 | pair of recesses |
| 94 | universal connector |
| 96 | quick clip |
| 98 | second end of first roller |
| 100 | clip |
| 102 | plate |
| 104 | second roller |
| 106 | pair of screws |
| 108 | wood lathe |
| 110 | engagement plate of wood lathe |
| 112 | rest plate of wood lathe |

DETAILED DESCRIPTION OF THE PREFERRED EMBODIMENT

Turning now descriptively to the drawings, in which similar reference characters denote similar elements throughout the several views, FIGS. 1 through 11 illustrate a multi-use craftsman table 10, comprising a tool table 12 and a plurality of specific tool accessories 14, to perform a variety of operations on wood work pieces according to known machining operations. Each specific tool accessory 14 can be assembled and attached to the tool table 12 to perform its respective operation on a wood work piece. Any number of tool accessories 14 can be attached to the tool table at any one time.

Figure 2:
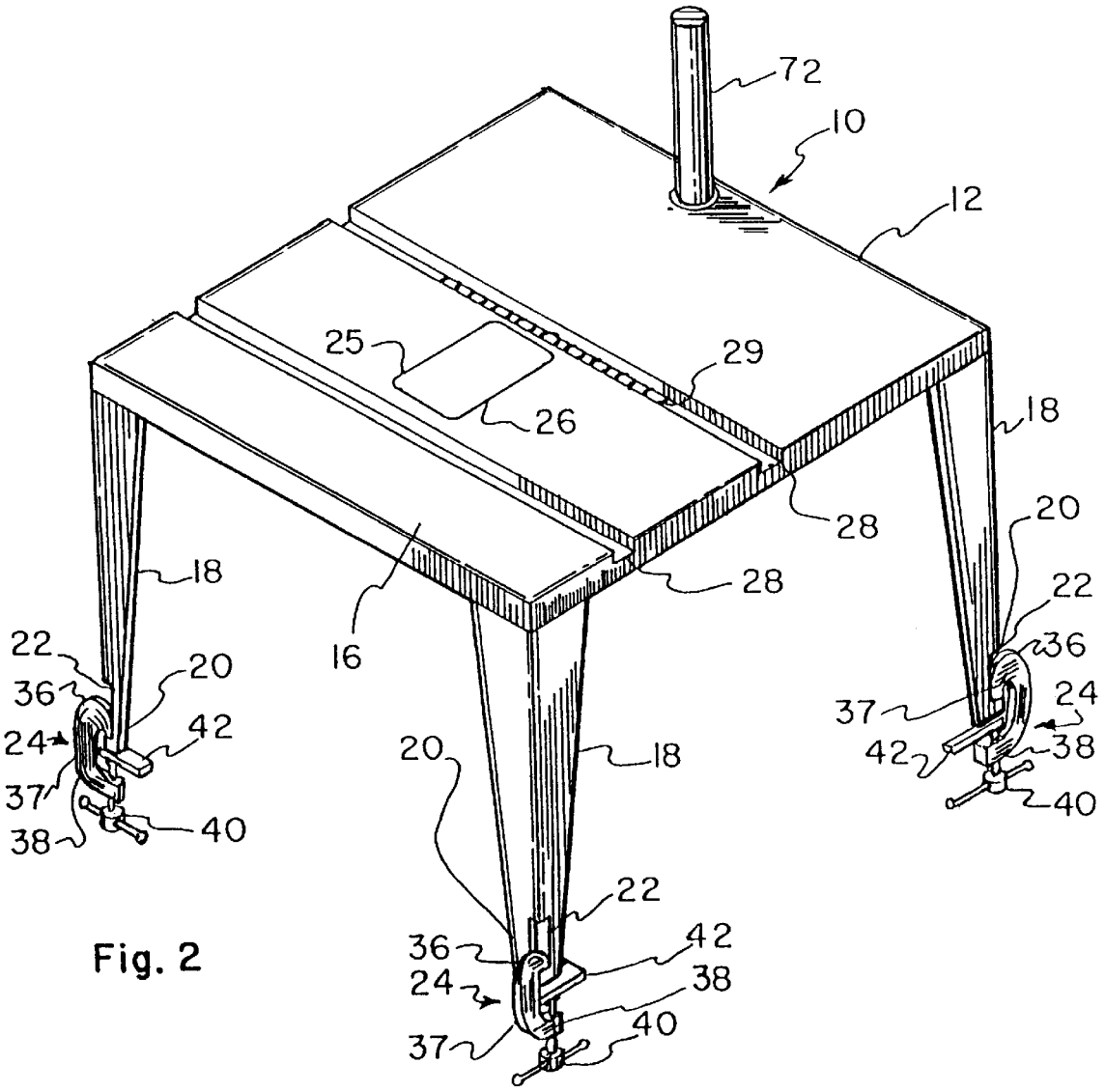
FIG. 2 is a perspective top view of the multi-use craftsman table of the present invention.
Figure 3:
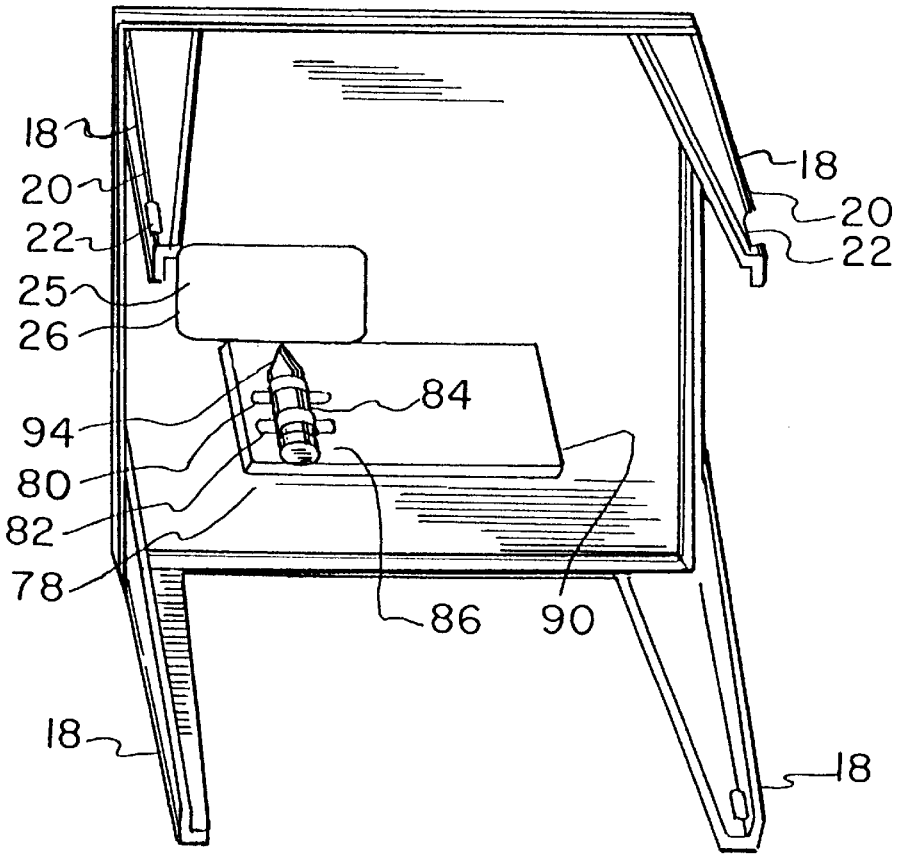
FIG. 3 is a bottom view of the multi-use craftsman table of the present invention.
Figure 4:
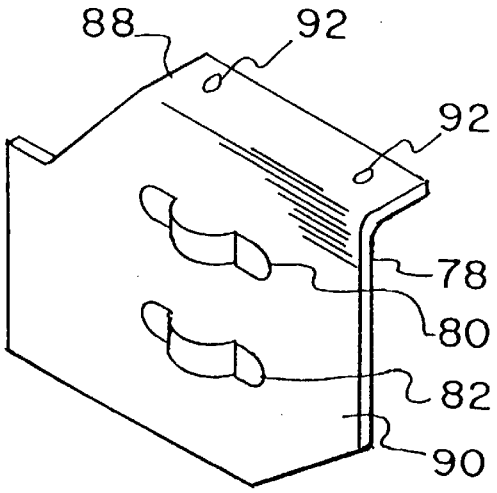
FIG. 4 is a perspective top view of a bracket connected to the multi-use craftsman table of the present invention.

The tool table 12, as can best be seen in FIGS. 1–3, consists of a tool table top 16 and a plurality of legs 18 extending downwardly from the tool table top 16 so as to elevate the tool table top 16. Each leg 18 is detachable from the tool table top 16 providing ease in packaging and storing of the multi-use craftsman table 10. A lower portion 20 of each leg 18 includes a machined slot 22 for receiving a C-clamp 24. The legs 18 are preferably formed from 4–18 gage steel. However, any material suitable for performing the function of the legs 18 as will become evident from the following disclosure may be used. Such material includes but is not limited to any metal or metal alloy thereof, plastic and wood.

The table top 16 includes a recess 25 extending therethrough for placement of a guide plate 26. Within the recess is a ledge 27 on which the guide plate 26 rests. The guide plate 26 will drop into the recess 25 from a top side of the table 12 opposite the positioning of the legs 18 and acts as a guide for tool accessories 14 attached to the multi-use craftsman table 10. The guide plate 26 and recess 25 are identical in shape providing a flush fit between each guide plate 26 and the side walls of the recess 25. The shape of the recess 25 and thus the guide plates 26 is preferably square although any shape providing an appropriate conduit for its respective tool to meet the work piece is acceptable.

Figures 5A, 5B, 5C, 5D, 5E:
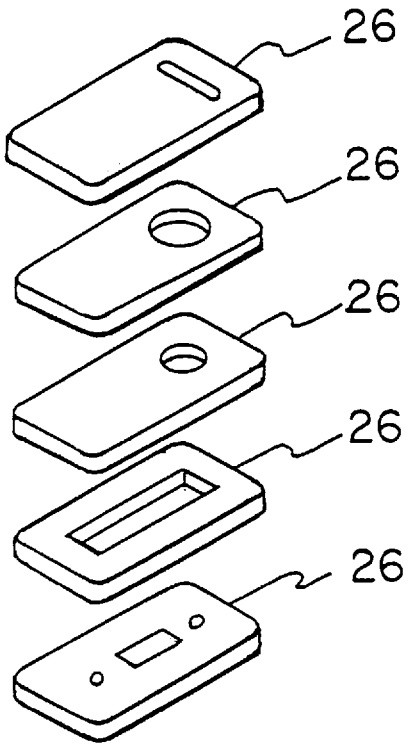
FIG. 5A is a perspective top view of a first guide plate associated with a rotary saw for use with the multi-use craftsman table of the present invention.
FIG. 5B is a perspective top view of a second guide plate associated with a drum sander for use with the multi-use craftsman table of the present invention.
FIG. 5C is a perspective top view of a third guide plate associated with a router and drill press for use with the multi-use craftsman table of the present invention.
FIG. 5D is a perspective top view of a fourth guide plate associated with a belt sander for use with the multi-use craftsman table of the present invention.
FIG. 5E is a perspective top view of a fifth guide plate associated with a jig saw for use with the multi-use craftsman table of the present invention.

A blank guide plate 26 is illustrated in FIG. 2 to restrict access of any tool positioned therebelow. The blank guide plate 26 is used to cover the recess 25 when the multi-use craftsman table 10 is not in use or a tool connected above the tool table top 16 is in use. Guide plates 26 for use with different tools and formed to be received by the recess 25 are illustrated in FIGS. 5A–5E. FIG. 5A illustrates a guide plate 26 for use with a rotary saw. FIG. 5B shows a guide plate 26 for use with a drum sander. FIG. 5C depicts a guide plate 26 for use with one of a router and drill press. FIG. 5D illustrates a guide plate 26 for use with a belt sander and FIG. 5E shows a guide plate used with a jig saw.

Figure 11:
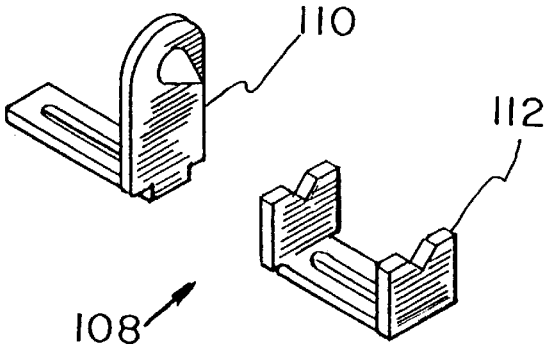
FIG. 11 is a perspective top view of a wood lathe for use with the multi-use craftsman table of the present invention.
Figure 7:
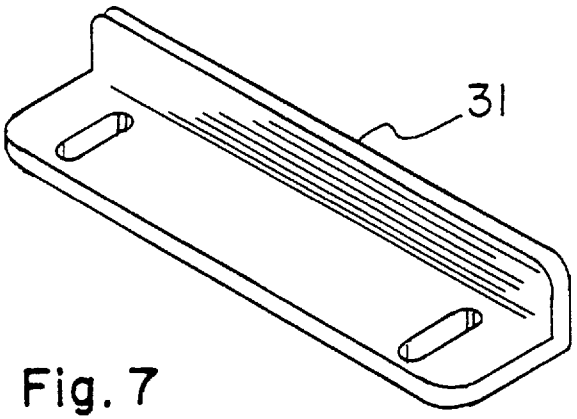
FIG. 7 is a perspective top view of a steel combination rip fence and turning tool rest for use with the multi-use craftsman table of the present invention.

A pair of grooves 28 extend along a length of the table top 16, one on each side of the recess 25. At least one of the grooves 28 includes a connection device 29 for attachment of a combination rip fence and turning tool rest 31 as illustrated in FIG. 7. A wood lathe 108 including an engagement plate 110 and a rest plate 112 as illustrated in FIG. 11 may also be connected to the table top 16 via the connector 29. The connector 29 may be in the form of a plurality of holes positioned within one or both of the grooves 28 and extending through the table top 16. In this embodiment the combination rip fence and turning tool rest 31 or the wood lathe 108 may be connected to the connector via screws. Alternatively, a pair of clamps (not shown) may be positioned on either end of the combination rip fence and turning tool rest 31 for removably connecting the combination rip fence and turning tool rest 31 to the table top 16.

Figure 6:
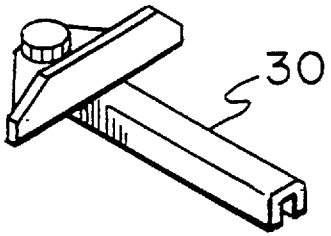
FIG. 6 is a perspective view of a cross-cut guide for use with the multi-use craftsman table of the present invention.

A guide member 30 as is illustrated in FIG. 6 is formed to extend within at least one of the pair of grooves 28. The guide member 30 acts to guide the movement of a work piece through a work area above the guide plate 26 wherein a selected tool accessory 14 attached to the multi-use craftsman table 10 may operate on the work piece. A pole or upstanding column 72 is also connected to extend from the table top 16 for attachment of a tool accessory 14 thereto.

A bottom side of the table top 16 is illustrated in FIG. 3. The bottom side includes a pair of holes on each side of the recess 25 for attachment of a bracket 78. The bracket 78 is illustrated in greater detail in FIG. 4. The bracket 78 includes first and second clamps 80 and 82 for holding a motor end 84 of a motor tool 86 at a position beneath the recess 25. Preferably, the motor tool will include a flexible shaft and a rotatable top end for connection with a tool accessory although any motor or motor tool able to be clamped to the bracket for placement under the recess in the tool table top 16 may be used. A first top side 88 of the bracket 78 extends at a 90 degree angle from a second vertically extending side 90. The first top side 88 includes a pair of recesses 92 extending therethrough for releasably attaching the bracket 78 to the bottom side of the table top 16 via a pair of screws 106 or any other suitable device able to maintain the bracket 78 in position on the bottom side of the table top 16. The motor end 84 of the motor tool 86 includes a universal connector 94 positioned on a top side of the motor tool 86. The universal connector 94 is positioned below the recess 25 when the motor tool 86 is clamped to the bracket 78. The universal connector 94 allows connection of the motor tool 86 to any tool having a corresponding connection device and, via its position below the recess, allows any tool connected thereto to extend through the recess 25 and associated guide plate 26 for operating on a work piece positioned on the table top 16.

A C-clamp 24 is secured within the machined slot 22 of each leg 18 for use in securing its respective leg 18 to a table top 34 of a work table 32 as is clearly illustrated in FIG. 1. Each C-clamp 24 includes a securing jaw 36 positioned and secured within the machined slot 22 of its respective leg 18 and a free jaw 38 extending parallel to the securing jaw 36 and below the leg 18. A mid section 37 of the C-clamp 24 acts to maintain a constant separation distance between the securing jaw 36 and the free jaw 38. The separation distance is large enough to fit a table top 34 between the securing jaw 36 and the free jaw 38. A fastening screw 40 is threaded into a recess extending through the free jaw 38 of each C-clamp 24. The fastening screw 40 of each C-clamp 24 acts to engage a lower side of a table top 34 positioned between the securing jaw 36 and free jaw 38, securing the respective legs 18 and thus the multi-use craftsman table 10 to the work table 32. A rubber pad 42 may be positioned on a face side of the free jaw 38 of each C-clamp 24 to engage a bottom side of the table top 34 of the work table 32. The rubber pad 42 provides a frictional engagement with the work table 32 while also acting to cushion and protect the surface of the work table 32 from the pressure applied by the fastening screw 40.

Examples of tool accessories 14 which may be connected to the multi-use craftsman table 10 are a table saw 44, a router, a drum sander, a belt sander 50, a wood lathe 52, a drill press 54, a radial arm saw 56 and a jig saw. Any combination of the above tool accessories 14 can be coupled to the tool table top 16 at any particular time as is shown in FIG. 1. The multi-use craftsman table 10, further includes a tool rest support 58, that can also be secured onto the tool table top 16.

Figure 8:
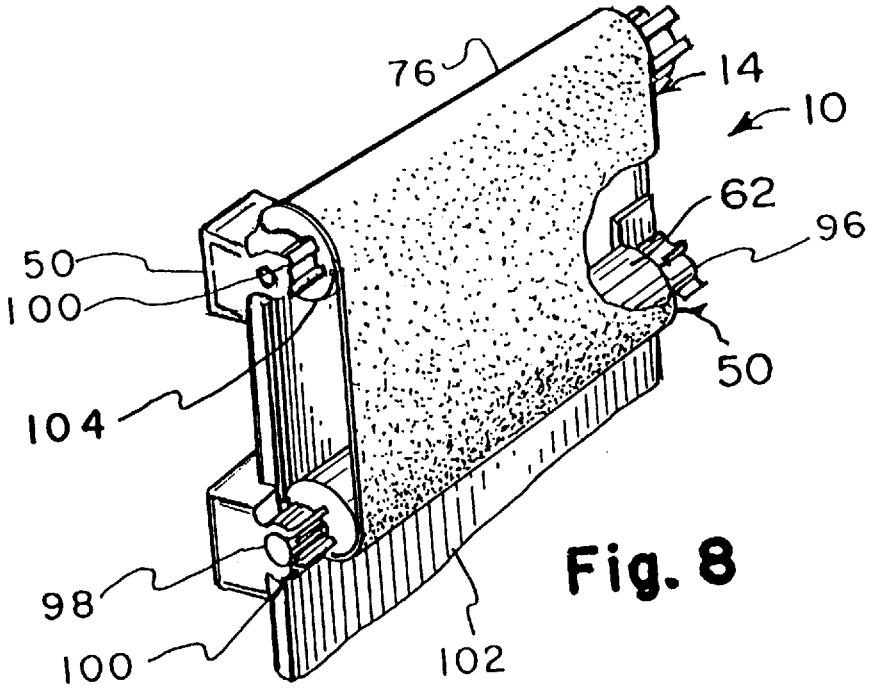
FIG. 8 is a perspective view with parts broken away of a portion of a belt sander showing quick clip-on rollers in greater detail.

The belt sander 50 includes a quick clip 96 on a first roller 62 for fast assembly thereto, as shown in FIG. 8. The quick clip 96 is readily fastened to the universal connector 94 on the motor 84 of the motor tool 86. A second end 98 of the first roller 62 is rotatably connected to a clip 100 on a fastening plate 102. A second roller 104 is also rotatably connected to the fastening plate 102 via a clip 100. A piece of sand paper 76 is positioned between and around the first and second rollers 62 and 104 for rotation with the first and second rollers 62 and 104. When the quick clip 96 is connected to the motor 84 it is positioned to extend through the recess 25 and the appropriate guide plate 26, illustrated in FIG. 5D, positioned therein. When the motor 84 is turned on, the first roller 62 and thus the second roller 104 and sand paper 76 are caused to rotate and sand down a work piece paced in contact therewith. The motor tool 86 may be connected to an outside power source by connecting a power cord thereto or may include an internal power source for independent operation.

Figure 10:
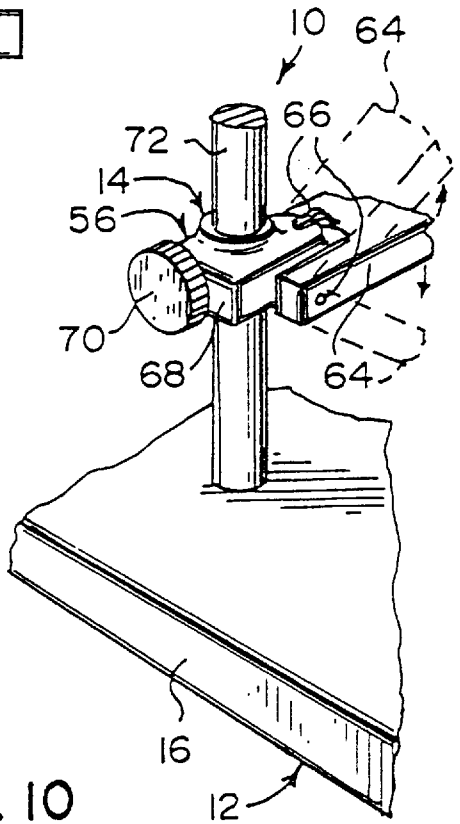
FIG. 10 is a perspective top view of a portion of the radial arm saw in FIG. 6, showing the spring pivot in greater detail.
Figure 9:
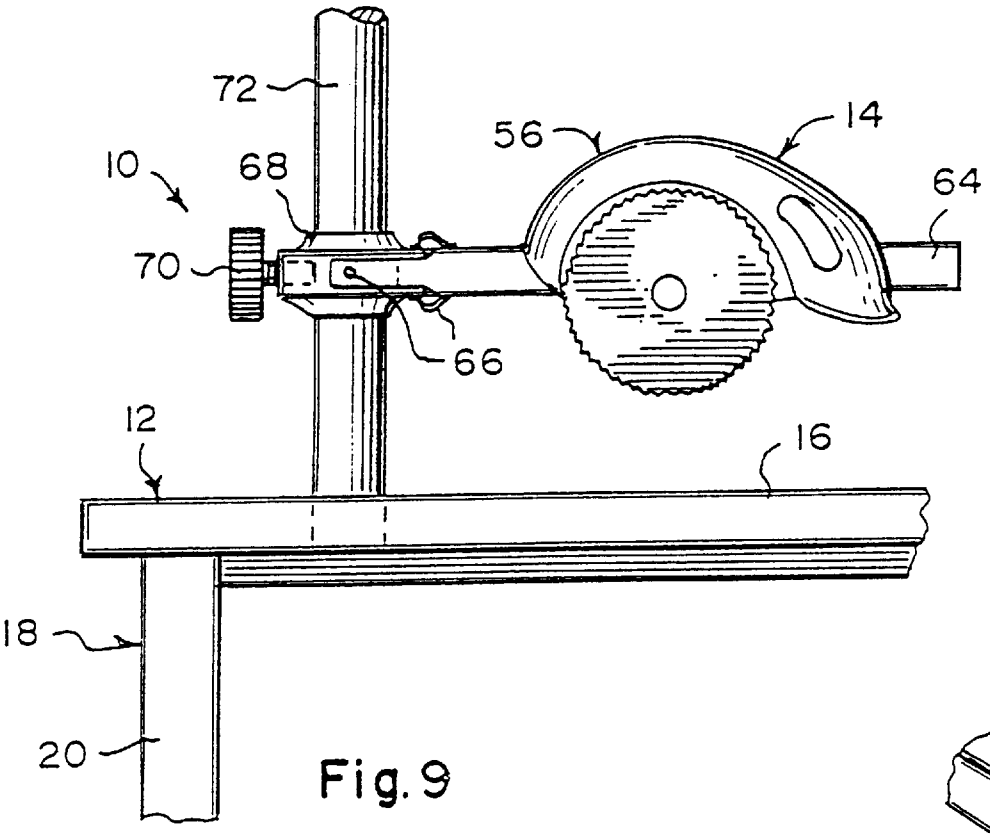
FIG. 9 is a perspective side view with parts broken away, showing the radial arm saw on the column of the tool table top.

The radial arm saw 56 is illustrated in FIGS. 9 and 10 and contains a longitudinal arm 64 holding the radial saw 56 in position. The longitudinal arm includes a spring pivot 66 and is connected to an adjustable collar 68. A locking screw 70 is connected to the upstanding column 72 extending from the tool table top 16 for adjustably connecting the longitudinal arm 64 and thus the radial arm saw 56 to the upstanding column at a desired height above the table top 16.

In use, the tool accessories 14, such as the table saw 44, the router 46, the drum sander 48, the belt sander 50, the wood lathe 52, the drill press 54 and the radial arm saw 56, are mounted on the tool table top 16 of the tool table 14. Any number and combination of tool accessories 14 can be attached to the tool table top 16 and universal connector 94 of the motor tool 86 depending upon the project to be performed and the types of tools needed.

The fastening screw 40 of each of the C-clamps 24 are placed in an open unscrewed position and the tool table 12 is positioned atop the work table 32. The free jaw 38 of each C-clamp 24 is positioned on an underside of the table top 34 of the work table 32 and their respective fastening screws 40 are turned in a clockwise direction causing the fastening screw 40 to extend further into the recess through the free jaw 38. The fastening screw 40 is continually rotated until the rubber pad 42 thereon is in firm contact with an underside of the table top 34. The tool table 10 is now secured to the table top 34 of the work table 32, the work table 32 being positioned between the legs 18 of the tool table 12 and each respective fastening screw 40. The rubber pads 42 on the fastening screw 40 are now in tight engagement with the table top 34 of the work table 32.

At this point, the bracket 78 is attached to the bottom side of the table top 16 on the desired side of the recess 25 and the motor end 84 of the motor tool 86 is clamped thereto. The desired tool for acting on the work piece is then connected to the motor end 84 of the motor tool 86 and the plate 26 corresponding to the desired tool is placed in the recess 25. The combination rip fence and turning tool rest 31 is then connected to the tool table top 16 either using the connectors 29 within the grooves 28 or a pair of clamps positioned on either end thereof and the cross-cut guide 30 is then positioned within at least one of the pair of grooves 28 in the proper position for the desired operation. If movement of the work piece through the work area beneath the selected tool accessory 14 is desired, the work piece is guided through the work area by the guide 30 and alongside the combination rip fence and turning tool rest 31.

The respective operation according to known machining operations is then performed on one of the wood work pieces using the selected tool accessory 14. After performing the desired operation the selected tool accessory 14 is moved out of the work area and secured in an inoperable position. Another tool accessory 14 is then selected and moved into the work area. The plate 26 associated with the newly selected tool accessory 14 is positioned within the recess 25 replacing the plate 26 associated with the previously used tool accessory 14 and operation on the work piece is begun. This process is repeated with each desired tool accessory 14 connected to the multi-use craftsman table until the work piece is completed.

From the above description it can be seen that the multi-use craftsman table is able to overcome the shortcomings of prior art devices by providing a multi-use craftsman table which can readily be converted with specific tool accessories to perform a variety of operations on wood work pieces, according to known machining operations. The present invention is also can be adjustably mounted to a work table, so that the variety of operations such as drilling, shaping, routing, sanding, sawing, turning and milling can be performed without interruption by assembling the specific tool accessories for any of the operations on the tool table. The present invention also includes a plurality of plates or inserts which are each positionable atop the table, each plate acting to guide movement of a respective tool; detachable receiving and secured slot at a bottom end thereof for receiving and securing a C-clamp thereto; grooves along a length of the table top; and a guide member for moving along the grooves and guiding a tool along the length of the table. Furthermore, the present invention is simple and easy to use and is economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A multi-use craftsman table for connection of at least one of a plurality of tools for performing a variety of operations on wood work pieces, said multi-use craftsman table comprising:

a) a bracket including at least one clamp for releasably securing at least one of the plurality of tools;

b) a tool table top including a face side and a bottom side, said face side including a length, a recess extending therethrough, and first and second grooves extending along said length and on either side of said recess and said bottom side including means for connecting said bracket to said bottom side wherein said at least one of said plurality of tools is aligned with said recess;

c) at least one clamp; and d) at least one leg having a top end and bottom end, said top end being releasably connected to said bottom side of said tool table top and said bottom end including a machined slot for receiving said at least one clamp, said at least one clamp acting to secure said multi-use craftsman table to a table top of a work table.

2. A multi-use craftsman table as recited in claim 1, further comprising a combination rip fence and turning tool rest and at least one of said first and second grooves includes means for connecting said combination rip fence and turning tool to said tool table top.

3. A multi-use craftsman table as recited in claim 2, further comprising a wood lathe connected to said means for connection.

4. A multi-use craftsman table as recited in claim 1, further comprising a vertical column extending from said face side of said tool table top for providing a connection for at least one of the plurality of tools.

5. A multi-use craftsman table as recited in claim 1, wherein said at least one clamp member is a C-clamp including:

a) a securing jaw positioned within and secured to said machined slot in said at least one leg;

b) a free jaw including a recess extending therethrough spaced from and extending perpendicular to said at least one leg; and c) a fastening device including a face surface extending through said recess, said fastening device being rotatable within said recess in one of a fastening direction and an unfastening direction.

6. A multi-use craftsman table as recited in claim 5, further comprising a rubber pad applied to said face surface of said fastening device, for engaging with an end of the table top of the work table upon rotation of said fastening device in said fastening direction.

7. A multi-use craftsman table as recited in claim 2, further comprising a guide means for mating with at least one of said grooves and moving a work piece along the length of said tool table top.

8. A multi-use craftsman table as recited in claim 1, further comprising a motor tool having a universal connector releasably secured to said bracket by said clamp, said universal connector being connectable with said plurality of tools and positioned below said recess extending through said face side of said tool table top when secured to said bracket.

9. A multi-use craftsman table as recited in claim 8, further comprising a plurality of guide plates, each guide plate being positionable within said recess extending through said face side of said tool table top for guiding a respective one of said plurality of tools connected to said universal connector.

10. A multi-use craftsman table as recited in claim 9, wherein each of said plurality of plates and said recess are square shaped.

11. A multi-use craftsman table as recited in claim 10, wherein one of said plurality of guide plates is a blank plate for restricting access to said face side of said tool table top through said recess.

12. A multi-use craftsman table as recited in claim 11, wherein said bracket includes a first vertically extending side for receiving said clamps and releasably securing said motor tool thereto and a second side extending perpendicular to said first side for connection with said bottom side of said tool table top.

13. A multi-use craftsman table as recited in claim 1, wherein one of said plurality of tools is a drum sander, which can be coupled to said tool table top.

14. A multi-use craftsman table as recited in claim 1, wherein one of said plurality of tools is a belt sander, which can be coupled to said tool table top.

15. A multi-use craftsman table as recited in claim 1, wherein one of said plurality of tools is a wood lathe, which can be coupled to said tool table top.

16. A multi-use craftsman table as recited in claim 1, wherein one of said plurality of tools is a drill press, which can be coupled to said tool table top.

17. A multi-use craftsman table as recited in claim 11, wherein one of said plurality of tools is a radial arm saw, which can be coupled to said tool table top.

18. A multi-use craftsman table as recited in claim 12, further including a tool rest support that can be secured onto said tool table top.

19. A multi-use craftsman table as recited in claim 14, wherein said belt sander includes a quick clip on roller for fast assembly thereto and connection with said universal connector.

20. A multi-use craftsman table as recited in claim 17, wherein said radial arm saw includes a longitudinal arm having a spring pivot on an adjustable collar having a locking screw, which fits upon an upstanding column on said tool table top.

* * * * *